United States Patent [19]

Orii

[11] Patent Number: 4,589,605

[45] Date of Patent: May 20, 1986

[54] LOOPING APPARATUS FOR COILED MATERIAL

[75] Inventor: Masaru Orii, Machida, Japan

[73] Assignee: Yugengaisha Kyodogiken, Tokyo, Japan

[21] Appl. No.: 685,317

[22] Filed: Dec. 24, 1984

[30] Foreign Application Priority Data

Dec. 29, 1983 [JP] Japan ..... 58-248474

[51] Int. Cl.[4] ..... B65H 16/04

[52] U.S. Cl. ..... 242/55

[58] Field of Search ..... 242/55, 76, 55.17, 78.6, 242/78.7

[56] References Cited

U.S. PATENT DOCUMENTS

| | | | |
|---|---|---|---|
| 3,258,212 | 6/1966 | La Tour | 242/55 |
| 3,534,918 | 10/1970 | Clark | 242/55 |
| 3,885,748 | 5/1975 | Costello et al. | 242/55 |
| 3,888,430 | 6/1975 | Costello et al. | 242/55 |
| 4,505,438 | 3/1985 | Sendzimir | 242/78.7 X |

*Primary Examiner*—Stuart S. Levy
*Assistant Examiner*—Lynn M. Sohacki
*Attorney, Agent, or Firm*—Collard, Roe & Galgano

[57] ABSTRACT

A coiled material looping apparatus is provided having a loop guide mechanism which guides the material unwound by the uncoiler mechanism into a spiral loop that spirals or deviates perpendicular to the direction of material feed so that the loop is formed at the side of the coiled portion of the material.

8 Claims, 8 Drawing Figures

LOOPING APPARATUS FOR COILED MATERIAL

BACKGROUND OF THE INVENTION

1. Field of the Invention

The present invention relates to a looping apparatus for looping coiled material before feeding it to a pressing machine.

2. Description of the Prior Art

In the primary process line of a pressing machine, the material to be worked, which is coiled, is fed a predetermined distance intermittently into the pressing machine while at the same time a coil of the material is unwound by an uncoiler. Thus, usually a loop of the material is formed before being fed to an intermittent feeding device such as a roller feeder or a leveler feeder.

FIGS. 1 to 3 show a primary process line of the conventional press using a leveler feeder as an intermittent feeding device.

FIG. 1 illustrates an example in which a loop 1*a* of the coil material 1 is formed below the uncoiler 2. In this case a hole 3 is dug in the ground to allow for a loop 1*a*. The coil material 1 is continuously unwound by the uncoiler 2 and is sent via loop 1*a* to a leveler feeder 4 which corrects the winding strain of the material and intermittently impels the coil material a predetermined distance and feeds it into the press 5.

FIG. 2 shows an example where a loop 1*a* is formed behind the uncoiler 2. A loop guide 6 is provided to form a predetermined size of loop 1*a*.

FIG. 3 shows an example where a loop 1*a* is formed off to the upper rear of the uncoiler 2.

In either case, as shown in FIGS. 1 to 3, the conventional primary process line of the pressing machine is inevitably long.

SUMMARY OF THE INVENTION

The object of this invention is to solve the problems mentioned above and provide a coiled material looping apparatus which can shorten the length of the primary process line of the pressing machine.

According to this invention, an uncoiler mechanism is provided to hold the coiled portion of the material and to unwind the coils by rotating it; a loop guide is provided to guide the material uncoiled from the uncoiler mechanism into a spiral loop that spirals or deviates in the direction perpendicular to that of the material feed, thereby the spiral loop is formed at the side of the coiled portion of the material. This construction can make the primary process line of the press shorter.

Other objects and features of the present invention will become apparent from the following detailed description considered in connection with the accompanying drawings. It is to be understood, however, that the drawings are designed as an illustration only and not as a definition of the limits of the invention.

BRIEF DESCRIPTION OF THE DRAWINGS

In the drawings wherein similar reference characters denote similar elements throughout the several views.

DETAILED DESCRIPTION OF THE PREFERRED EMBODIMENT

Figure 1:
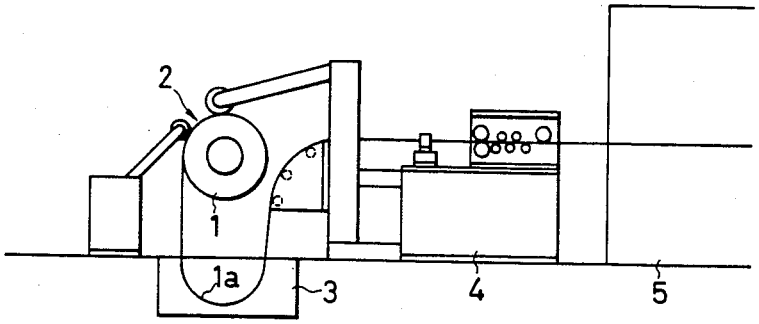
FIG. 1 PRIOR ART
FIG. 1 shows a front view of one example of primary process line of the conventional press.

The present invention will now be described in detail in conjunction with one embodiment shown in the drawings.

Figure 4:
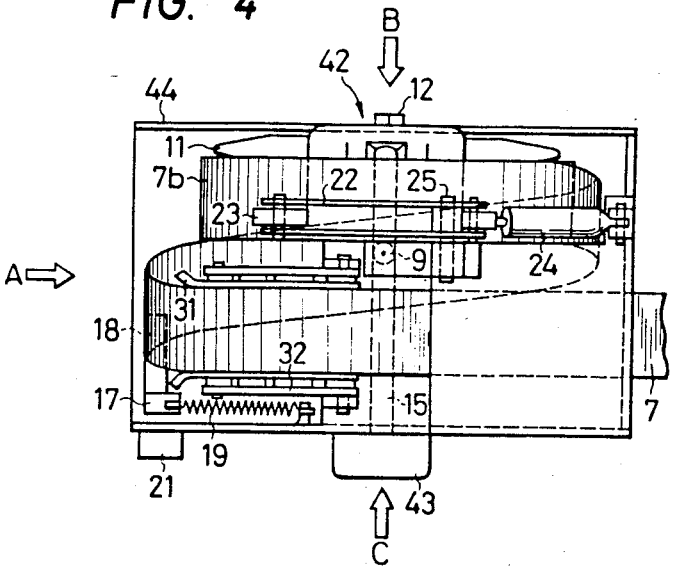
FIG. 4 shows a plan view of one embodiment of the invention.

Now turning to the drawings, there is shown in FIG. 4 a material 7 to be worked by the press and the coiled portion 7*b* of the material 7 supported on the reel drum 8 (see FIG. 7) is held between a roll width guide 9 and a width guide plate 10, and three width guides 11. An expansion bolt, designated 12, enables expansion or contraction of the reel drum 8 according to the inner diameter of the coiled portion 7*b* of the work material 7. The bolt 12 serves to secure the coiled portion 7*b* onto the reel drum 8. A motor 13 causes, through a chain 14, the sprocket 16 integral with the reel shaft 15 to rotate, thereby turning the reel drum 8.

A sensing bar 17 detects the looped condition (the amount of the loop) of the material 7. Bar 17 is provided with a roller 18 at the upper end 17*a* and a spring 19 at the lower end 17*b* (see FIG. 7) which urges the bar 17 to rotate in the direction of the arrow in FIG. 6 about the shaft 20. Thus the roller 18 is always kept in contact with the loop 7*a* of the material 7 while following the motion of the loop. A switch box 21 has two microswitches (not shown) that turn on when the sensing bar 17 inclines backward (in the direction that the amount of loop increases) from the vertical position or forward (in the direction that the amount of loop decreases). When the amount of loop is smaller than a reference value, one of the microswitches turns on to drive the motor 13. Conversely when the amount of loop exceeds the reference value, the other microswitch turns on to stop the motor 13.

Figure 5:
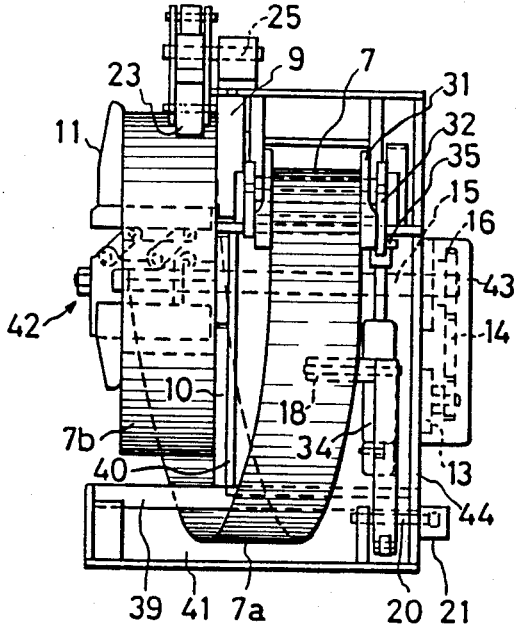
FIG. 5 shows a side view as seen from the arrow A of FIG. 4.
Figure 6:
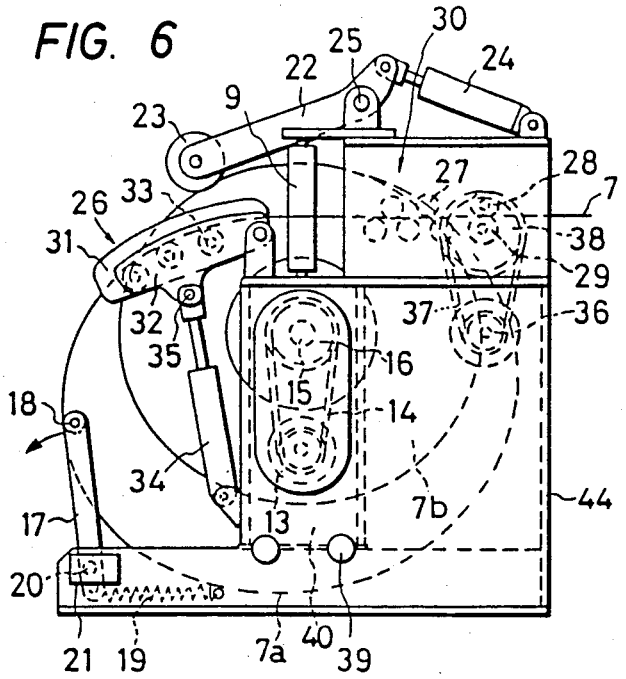
FIG. 6 shows a front view as seen from the arrow C of FIG. 4.
Figure 7:
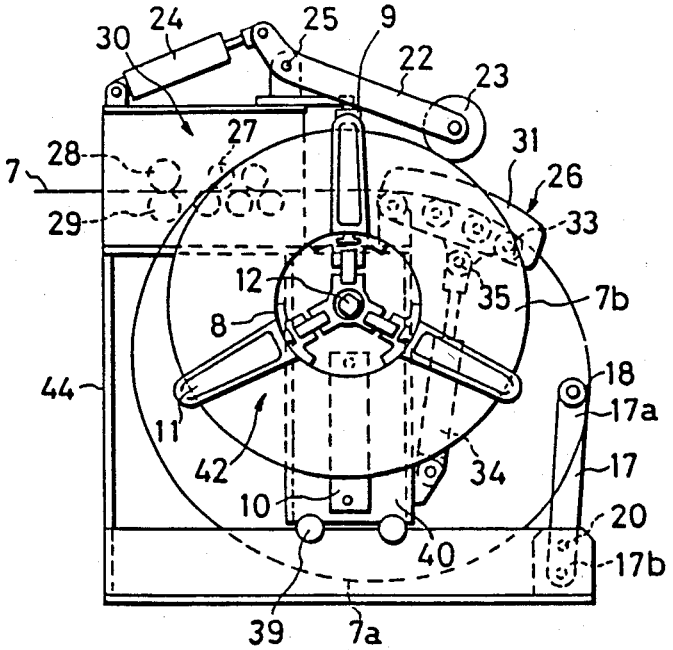
FIG. 7 shows a rear view as seen from the arrow B of FIG. 4.

A coil holding member, designated 22, has at one end a roller 23 to hold down the coiled material 7 and a cylinder 24 operated by a pressure medium at the other end. The coil holding member 22 is pivotable on the axis 25. The pressure exerted by the cylinder 24 on the coil holding member 22 causes the roller 23 to hold down the coiled material 7 keeping it from being unwound. A guide 26, as clearly seen in FIGS. 6 and 7, forms a spiral loop 7*a* and at the same time guides the unwound material 7 to the leveler feeder 30 which consists of upper and lower work rollers 27 and a pair of upper and lower pinch rollers 28, 29. The guide 26, as clearly seen in FIGS. 5 to 7, is made up of a width guide 31, a width guide frame 32 and four guide rollers 33 and is urged upward, through a connecting pin 35, by a cylinder 34 operated by a pressure medium mounted under the guide 26. A motor 36 is provided for the leveler feeder 30 (see FIG. 6) whereby the rotation of the motor is transmitted to gear pulley 38 through belt 37 to turn the lower pinch roller 29. This in turn causes the material 7 which has passed along the guide 26 to be fed to the press while the material is straightened out and relieved of winding strain by the upper and lower work rollers 27. A support bar, designated 39, supports the frame 40, which in turn sustains one end of the reel shaft 15. Below the support bar 39 is formed a space 41 (see FIG. 5) through which the loop *7a* of the material 7 unwound from the mandrel reel 42 (from the reel drum 8 to the expansion bolt 12) is passed. A cover 43 and a body frame 44 are also provided.

Figure 8:
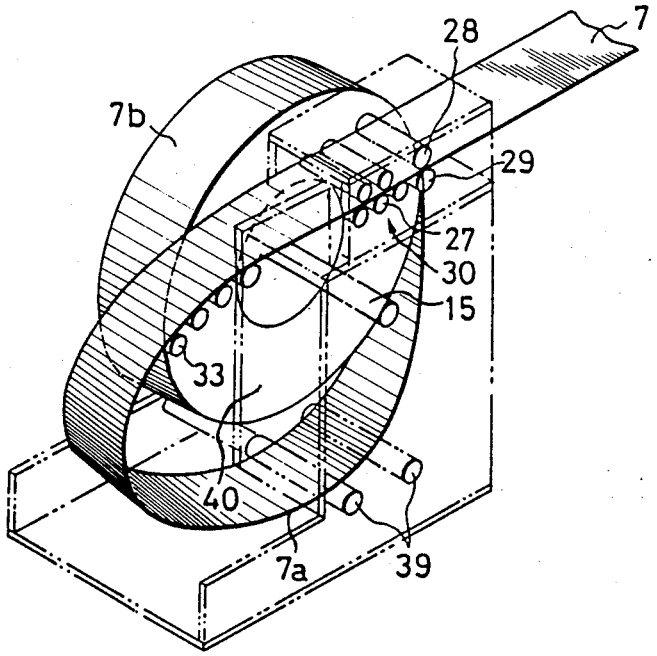
FIG. 8 shows a perspective view illustrating the coiled material being formed into a loop.

The material 7 unwound from the mandrel reel 42 is passed through the space 41 formed under the support bar 39 and guided into the shape of a spiral loop which is formed as the material is shifted sideways or in the direction perpendicular to that of feed while being fed (see FIGS. 5 and 8). Thus, the loop *7a* is formed at the side of the coiled portion *7b* of the material. The material released into the spiral loop is then fed to the leveler feeder 30. At this time, since the material 7 is fed forward a predetermined distance intermittently by the leveler feeder 30, the loop *7a* becomes large or small. The amount of loop is detected by the sensing lever 17. That is, the recovering force of the spring 19 attached to the lower end *17b* of the bar 17 urges the upper end *17a* toward the direction of the arrow in FIG. 6 so that the roller 18 at the upper end *17a* always follows the loop *7a*. Forward or backward inclination of the sensing bar 17 through more than a certain angle from the vertical position will operate the microswitches (not shown) in the switch box 21, thus controlling the motor operation 13 to keep the amount of loop at a predetermined value.

Figure 2:
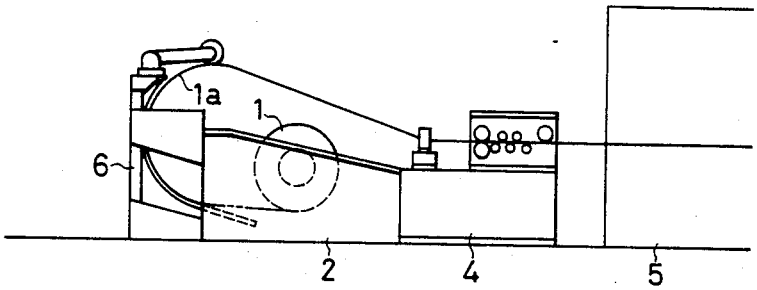
FIG. 2 PRIOR ART
FIG. 2 shows a front view of another example of primary process line of the conventional press.
Figure 3:
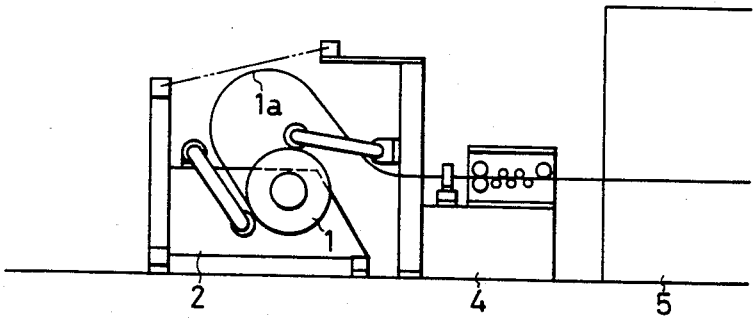
FIG. 3 PRIOR ART
FIG. 3 shows a front view of still another example of primary process line of the conventional press.

With this invention, since the spiral *7a* is formed at the side of the coiled portion *7b* of the material 7, the loop *7a* and the coiled portion *7b* overlap each other for the most part when viewed along the length of the uncoiling system and therefore the length of the primary process line of the pressing machine can be reduced. The depth will be longer than that shown in FIGS. 1 to 3. However, the depth of the pressing machine itself is great and there has been unused space in the depth direction of the uncoiler 1 of FIGS. 1 to 3. Thus, an increase in the depth means an increased utilization of otherwise unused space. Further, since the mandrel reel 42, guide 26 and leveler feeder 30 are assembled into an integral structure, a substantial reduction in the installation area is achieved. Moreover, common use of load table leads to a reduction in cost.

In the embodiment, the section from the motor 13 to the sprocket 16, the section from the coil holding member 22 to the axis 25, and the mandrel reel 42 form the uncoiler mechanism of this invention. The guide 26, the cylinder 34 for the guide and the connecting pin 35 form the loop guide mechanism of this invention.

In the illustrated embodiment the integral leveler feeder 30 is provided. Where there is no need to correct the winding strain of the material 7 an integral roller feeder may be provided. When a separate leveler feeder or roller feeder is used, a guide for horizontal movement of the material may be mounted in place of the leveler feeder 30.

While only a single embodiment of the present invention has been shown and described, it will be obvious that many changes and modifications may be made thereunto without departing from the spirit and scope of the invention.

What is claimed is:

1. An apparatus for looping coiled material comprising:

an uncoiler mechanism for holding a coiled portion of the material and for unwinding the coiled material by rotating the coiled portion of the material about a horizontal axis; and a loop guide mechanism disposed alongside said uncoiler mechanism for guiding the material unwound by the uncoiler mechanism helically from the coiled portion in a direction perpendicular to the direction of feed and forming a spiral loop of one turn, said loop guide mechanism including an adjustment means for adjusting the position of the loop top and said adjustment means having a fixed end and a free end, said fixed end pivotally fixed alongside said uncoiler mechanism, and said free end extending substantially vertically such that said loop guide mechanism engages said loop at an upper portion thereof, said uncoiler and loop guide mechanisms thereby providing a compact apparatus for looping coiled material.

2. The coiled material looping apparatus as defined in claim 1, in which the loop guide mechanism includes a width guide which determines the position of the material in the direction perpendicular to that of material feed.

3. The coiled material looping apparatus a defined in claim 1, in which the adjustment means includes a cylinder operated by a pressure medium.

4. The coiled material looping apparatus as defined in claim 1, which further includes an integral intermittent feeding device.

5. The coiled material looping apparatus as defined in claim 4, in which said integral intermittent feeding device is a leveler feeder.

6. The coiled material looping apparatus as defined in claim 1, which further includes a means for detecting the size of the loop and a drive means for the uncoiler mechanism controlled by the detecting means.

7. The coiled material looping apparatus as defined in claim 6, in which the detecting means consists of a rotatably supported bar, a roller attached to the end of the bar and maintained in contact with part of the loop, a spring to urge the roller so as to follow the loop, and a switch means which is operated when a detecting bar pivots through more than a predetermined angle.

8. The apparatus as defined in claim 1, wherein said loop guide mechanism additionally includes a plurality of rollers contained within a frame pivotally attached to said free end of said adjustment means.

* * * * *